US006217198B1

(12) United States Patent
Midiri, Jr.

(10) Patent No.: US 6,217,198 B1
(45) Date of Patent: Apr. 17, 2001

(54) PLANT LAMP FIXTURE

(76) Inventor: Paul Midiri, Jr., 122 Chestnut St. #400, Philadelphia, PA (US) 19106

( * ) Notice: Subject to any disclaimer, the term of this patent is extended or adjusted under 35 U.S.C. 154(b) by 0 days.

(21) Appl. No.: 09/287,913

(22) Filed: Apr. 7, 1999

Related U.S. Application Data

(63) Continuation of application No. 08/707,133, filed on Sep. 3, 1996, now Pat. No. 5,911,495.

(51) Int. Cl.[7] ..... F21S 8/08

(52) U.S. Cl. ..... 362/413; 362/122; 362/154; 362/389; 362/397; 362/431; 362/441; 362/805

(58) Field of Search ..... 362/410, 413, 362/122, 154, 387, 389, 397, 431, 418, 380, 401, 441, 449, 805; 248/519

(56) References Cited

U.S. PATENT DOCUMENTS

| | | | | |
|---|---|---|---|---|
| 554,089 | | 2/1896 | Quinn | 362/390 |
| 1,419,152 | * | 6/1922 | Lansing et al. | 47/66.6 |
| 1,460,992 | * | 7/1923 | Vehling | 362/253 |
| 1,614,102 | | 1/1927 | Cary | 362/412 |
| 3,939,338 | | 2/1976 | Giammalvo | 362/122 |
| 4,112,484 | | 9/1978 | Schwartz | 362/314 |
| 5,121,313 | | 6/1992 | Chang | 362/412 |
| 5,428,520 | * | 6/1995 | Skief | 362/427 |

FOREIGN PATENT DOCUMENTS 260467 12/1911 (DE) .

* cited by examiner

*Primary Examiner*—Alan Cariaso
*Assistant Examiner*—Ronald E. Delgizzi
(74) *Attorney, Agent, or Firm*—Woodcock Washburn Kurtz Mackiewicz & Norris LLP

(57) ABSTRACT

Methods and apparatus for converting a hollow receptacle into an electric lamp are disclosed. The receptacle may be converted into a lamp on its own, or may be further filled with an artificial or live plant. In a preferred embodiment, the lamp fixture of the present invention comprises a central section a plurality of resilient spokes extending from the central section in a lamp apparatus connected to the base. The base is inserted into the receptacle and the spokes engage one or more wall portions of the receptacle in order to secure the base. Preferably, additional wall bands are supplied in order to enhance the frictional engagement of the spokes with the receptacle. Additionally, it is preferred that the lamp portion be adjustable so that the height of the bulb and the receptacle can be adjusted, for aesthetic reasons, or in those embodiments wherein the receptacle is used as a planter, the height of the bulb can be adjusted in order to accommodate the growth or changing of the plant that is growing in the receptacle.

5 Claims, 8 Drawing Sheets

PLANT LAMP FIXTURE

CROSS-REFERENCE TO RELATED APPLICATIONS

This Application is a continuation of application Ser. No. 08/707,133, filed Sep. 3, 1996 and issued on Jun. 15, 1999 as U.S. Pat. No. 5,911,495.

The present invention relates to lamp fixtures. More specifically, the present invention relates to a lamp fixture used in converting bowls, planters, and vases into lamps.

BACKGROUND OF THE INVENTION

Fear of electrical parts near water or moisture is common. In the past, most standard lamp fixtures have been produced in metal. Metal submerged in water or in a moist environment corrodes, thus making the lamp fixture perishable and eventually dangerous. Moreover, no lamp fixture is known to have the safe and efficient ability to be placed in any shape bowl, planter, pottery, or vase for the purpose of converting the use of the bowl, planter, pottery, or vase into a decorative lamp.

SUMMARY OF THE INVENTION

One object of the present invention is to provide a fixture for use in converting bowls, planters, pottery, and vases into safe, easy to assemble decorative lamps that may contain live plants. It is also an object of the present invention to provide such a fixture which is of simple and inexpensive construction. Another object of the present invention is to provide such a fixture in form that can be disassembled quickly and easily for transference and reuse. A further object of the present invention is to provide such a fixture that may be adjusted to suit the height desired for both aesthetic reasons and so that it is adjustable with relation to the growth of the plant.

Finally, a still further object of the present invention is to provide the option of wiring the lamp so that the wire continues through the lamp and through the base of the bowl, planter, pottery or vase when a center hole is present.

These and other objects of the present invention are satisfied by the present invention, wherein a lamp fixture is provided for converting a hollow receptacle into an electric lamp comprising a base that has a central section and a plurality of resilient spokes extending from the central section, along with a lamp that is connected to the base such that when the base is inserted into the receptacle, the spokes engage one or more wall portions of the receptacle and thus secure the base of the lamp in the receptacle. Preferably, the spokes are scored by score lines so that portions can be removed by bending or cutting along one of the score lines in order to adjust its length to accommodate a variety of receptacles. Preferably the distal end of the spokes have a protruding portion which is most preferably comprised of an irregular band of resilient material, or alternatively, is a cylindrical section of resilient material. These protruding portions of the distal end of the spokes assist with the engagement of the spokes against the receptacle. In one preferred embodiment, the spokes of the base of the lamp fixture may bear suction cups 30 which attach the base to one or more wall portions of the receptacle. In certain preferred embodiments, the lamp fixture further comprises a wall band that is juxtaposed with the spokes, such that the wall band creates a frictional engagement with the receptacle. In certain embodiments, the wall band is a curved band that has a plurality of protrusions that may either be cylindrical, rectangular prisms, or any other shape. In certain embodiments, an additional band is also provided and this secondary band has a plurality of cutouts shaped and sized to fit over the protrusions of the wall band. In preferred embodiments, the lamp apparatus itself has an inner tube and an outer tube in telescoping engagement such that the distance from the light bulb to the receptacle is adjustable so that the fixture may be adjusted to accommodate varying plant heights, either as the plant grows, or if the plant is replaced or changed for seasonal, decorative or other reasons. Preferably, the electrical cord extends through the base into an opening in the receptacle, although the electrical cord may alternatively be run up the side of the receptacle and over the rim or lip of the receptacle. In certain embodiments, the receptacle has an opening in its bottom portion to accommodate the exit of the electrical cord or other portions of the apparatus.

In accordance with the present invention, methods of converting an open receptacle such as a vase, bowl or other object that holds a plant into a lamp are also disclosed.

DETAILED DESCRIPTION OF THE PREFERRED EMBODIMENTS

Figure 1:
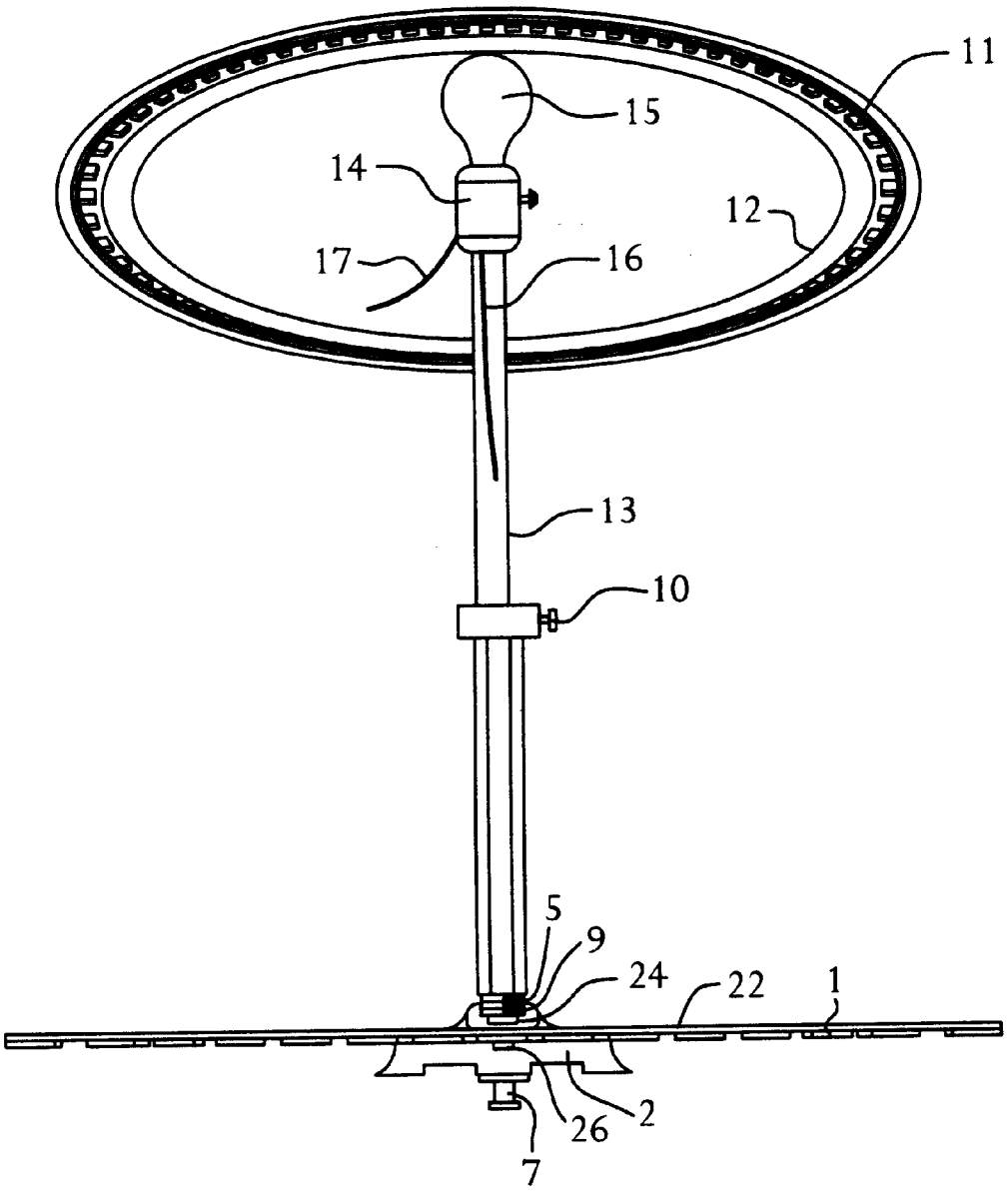
FIG. 1 is a side elevation of the plant lamp fixture made in accordance with the present invention.

As shown in the drawings, and particularly referring at first to FIG. 1, a preferred lamp fixture made in accordance with the present invention includes a removable base 1 of a circular shape which preferably is made of a flexible plastic material. The base 1 consists of flat or round resilient spokes 21 (seen in FIGS. 2A–2C) projecting out 30 from the center of the base 1 with a center circular area 22 approximately one third the diameter of the entire base 1 that is of solid plastic, thereby strengthening the center circular area 22.

Figure 2:
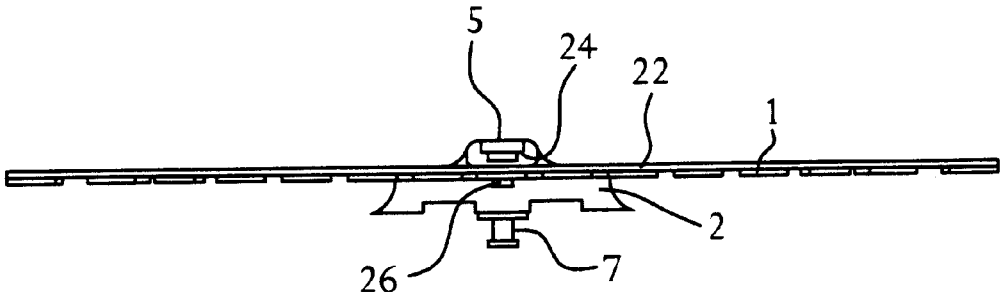
FIG. 2 is a fragmentary, side elevation of the base portion of the fixture illustrated in FIG. 1.
Figure 2A:
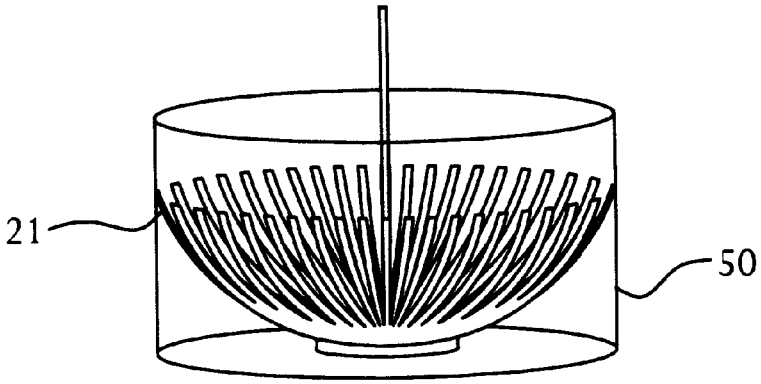
FIG. 2A is a side elevation of the plant lamp fixture demonstrating the use of the resilient spokes fitting against the side wall of a bowl receptacle.
Figure 2B:
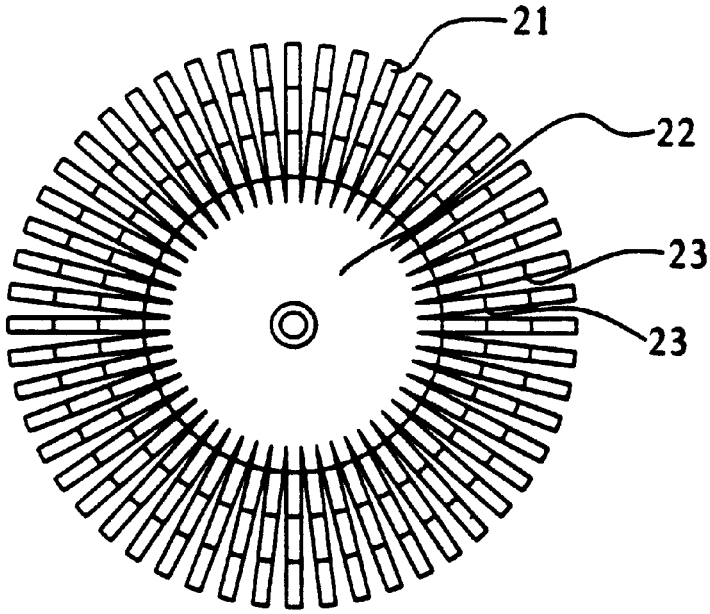
FIG. 2B is a fragmentary, top perspective view of the base portion of the fixture shown in FIG. 2.
Figure 2C:
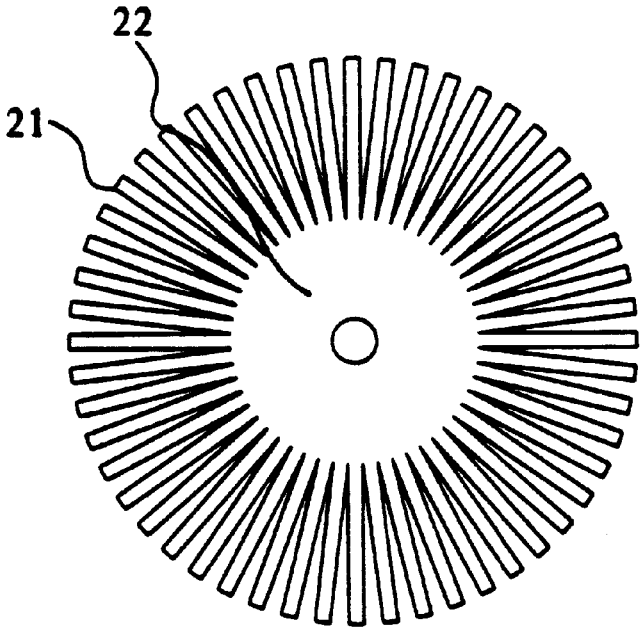
FIG. 2C is a fragmentary, bottom perspective view of the base portion of the fixture shown in FIG. 2.
Figure 3:
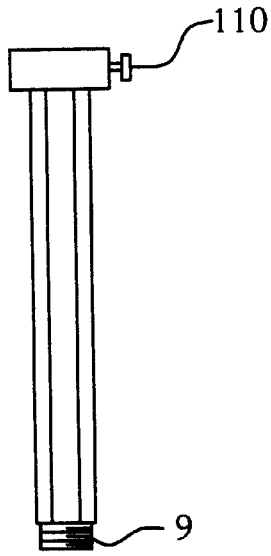
FIG. 3 is a fragmentary, side elevation view of the stem portion of the fixture.
Figure 4:
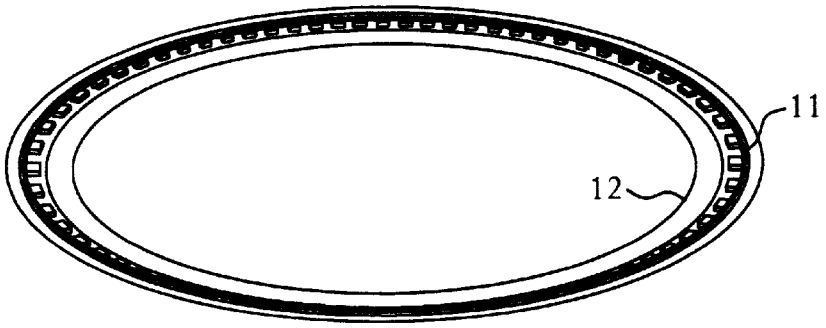
FIG. 4 is a fragmentary, top perspective view of the two securing bands used in conjunction with the fixture of the present invention.
Figure 4A:
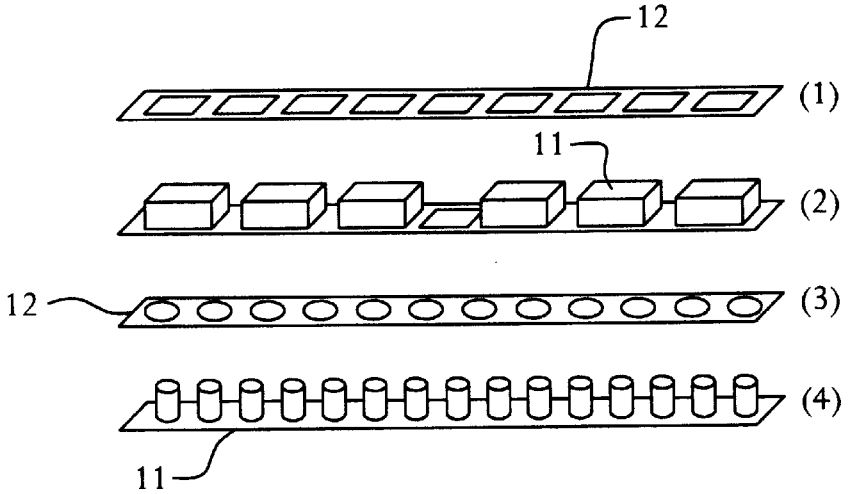
FIG. 4A is a fragmentary, side elevation of two versions of the locking band FIG. 4 of the fixture.
Figure 4B:
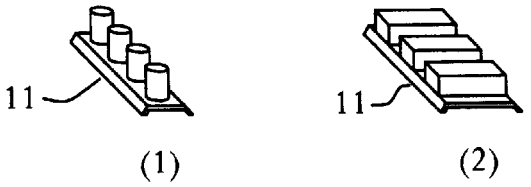
FIG. 4B is a fragmentary, top perspective of two versions of the wall band FIG. 4 of the fixture.
Figure 6:
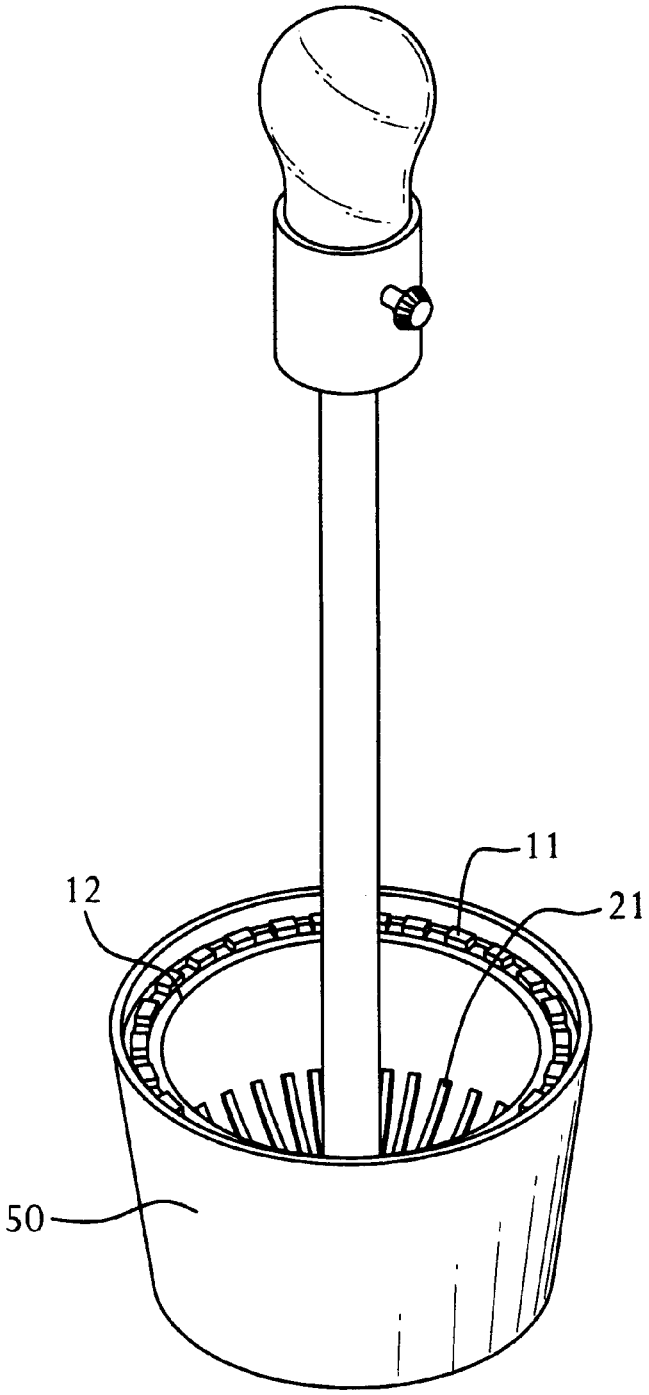
FIG. 6 is an isometric view demonstrating the wall band of the fixture juxtaposed with the spokes and engaged with the receptacle.
Figure 7:
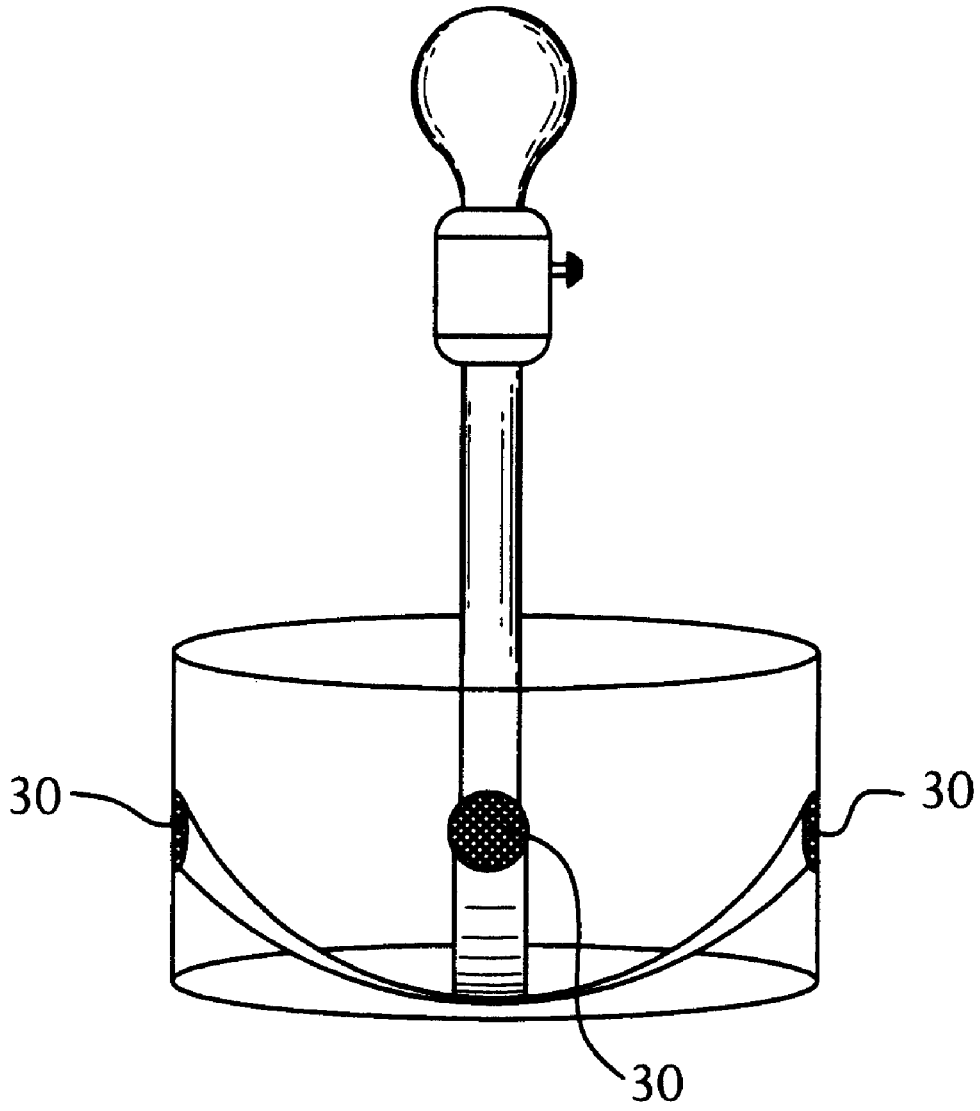
FIG. 7 is a side elevation of the plant lamp fixture demonstrating the use of suction cups to lock the fixture to the bowl receptacle.
Figure 8:
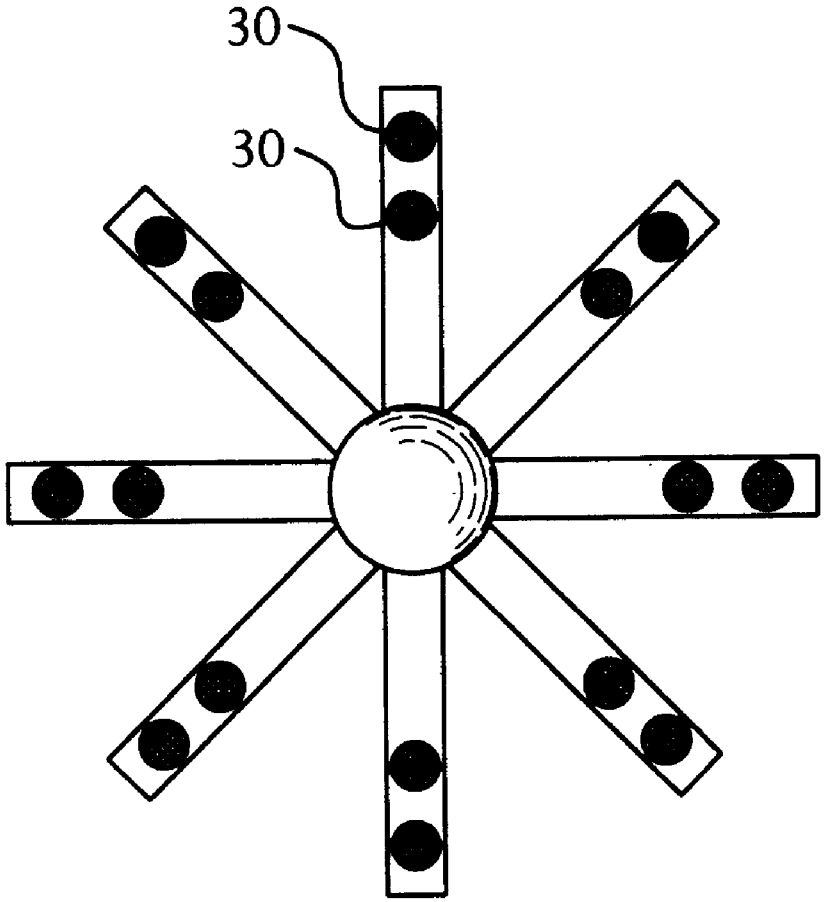
FIG. 8 is a fragmentary, top perspective view of the base portion of the fixture having suction cups.

The flat or round resilient spokes 21 preferably include scores 23 at different lengths, marking where they can be cut with scissors to preferred lengths. The center area 22 on the top of the base has an elevated 5 insertion hole that allows for the bottom stem portion of the fixture 9 to be inserted as seen in FIG. 3, by screwing snugly. The center area 22 preferably has a reduced insertion hole 24 just below the elevated insertion hole which continues the hole through the base itself, allowing a lamp extension pipe 7, preferably of firm plastic and of a standard size, to be inserted into the bottom of the base 1 further allowing the base 1 to be secured to a bowl 50, receptacle receptacle that has a center hole, as shown in FIG. 2. The extension pipe 7 is further secured to a bowl 50 or other receptacle with two rubber washers and two firm plastic lock nuts (not illustrated). The extension pipe 7 further allows the lamp wiring through the base of the lamp fixture and bowl, etc. receptacle.

The reduced insertion hole 24 in the center area 22 can be sealed with a plastic cap 26. The center area 22 on the bottom of the fixture base 1 preferably has a molded platform 2 which may serve as a stand. This allows the base 1 to be seated squarely in a receptacle 50 that has a round elevated center floor. The stem is preferably made of firm non-brittle plastic and has a hollow center allowing it to house a standard electric light bulb receptacle stem 13. Stem 13 may comprise a pipe. The stem is inserted into the center elevated insertion hole described above. A metal coupling 10 with an adjustable screw 110 allows the stem 13 to be adjusted to the height of the standard electric light bulb receptacle stem 13.

Securing bands 11,12, shown in FIG. 1, secure the fixture based in place along the inside wall of the bowl 50 or other receptacle by means of tension and suction. The wall band preferably is comprised of soft non-slip plastic, and most preferably has a concave bottom that when pressed against the wall of bowl or other receptacle creates a non-slip bond against the wall. The wall bands 11,12 may be cut to size and in certain embodiments, one band may include protruding rectangular blocks or short circular columns 12. The locking band 12 is preferably made of resilient plastic having rectangular or circular cut outs centered along the length of the band/strip sized to fit onto the wall band 11, locking it to the wall of the receptacle 50 after snugly placing wall band along the wall.

Figure 5:
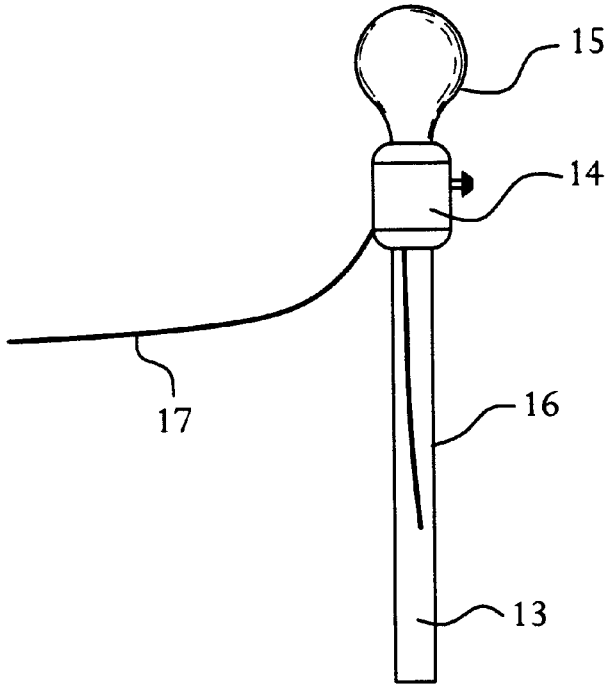
FIG. 5 is a fragmentary, side elevation of the top electrical unit and stem of the fixture.

The top unit includes a stem 13, illustrated in FIG. 5, preferably (e.g., a steel pipe), light bulb socket 14, and light bulb 15. All of these components are most preferably standard lamp parts. The stem 13 of the top unit fits into the stem of the lamp fixture described above. Electrical cord 16 or electrical cord 17 supplies power to light bulb 15. Electrical cord 16 illustrates certain embodiments in which the receptacle 50 has a bottom center hole through which electrical cord 16 may be extended. Electrical cord 17 illustrates certain other embodiments in which the electrical cord is run up the side of the receptacle and over the rim or lip of the receptacle.

Although the invention has been described in terms of an exemplary embodiment, the spirit and scope of the appended claims are not to be limited by any details not expressly stated in the claims. Upon review of the foregoing, numerous alternative embodiments will present themselves to those of skill in the art. Accordingly, reference should be made to the appended claims in order to determine the full scope of the present invention.

What is claimed:

1. A method of converting an open, hollow receptacle into an electric lamp comprising the steps of:

providing an open, hollow receptacle having wall portions, a rim portion and an opening at the bottom;

inserting a base into said receptacle: said base comprising a central section and a plurality of resilient spokes that extend from the central section into the receptacle whereby said spokes engage one or more wall portions of said receptacle, said receptacle being capable of accommodating an object extending towards said light bulb; and securing a lamp apparatus to said base; said lamp apparatus comprising a light bulb, an inner tube, and an outer tube, said inner tube and said outer tube being connected in telescopic engagement such that the distance between said light bulb and said receptacle is adjustable, wherein said spokes of said base comprise one or more suction cups which engage one or more wall portions of said receptacle by attachment of said suction cups to said wall portions.

2. A method of converting an open, hollow receptacle into an electric lamp comprising the steps of:

providing an open hollow receptacle having wall portions, a rim portion and an opening at the bottom;

inserting a base into said receptacle, said base comprising a central section and a plurality of resilient spokes that extend from the central section into the receptacle whereby said spokes engage one or more wall portions of said receptacle, said receptacle being capable of accommodating an object extending towards said light bulb;

securing a lamp apparatus to said base, said lamp apparatus comprising a light bulb, an inner tube, and an outer tube, said inner tube and said outer tube being connected in telescopic engagement such that the distance between said light bulb and said receptacle is adjustable; and planting a plant in the receptacle such that the plant is beneath said light bulb and surrounds the base, wherein said spokes of said base comprise one or more suction cups which engage one or more wall portions of said receptacle by attachment of said suction cups to said wall portions.

3. A lamp fixture for converting an open, hollow receptacle into an electric lamp, said receptacle having wall portions, said fixture comprising:

a base comprised of a central section and a plurality of resilient spokes that extend from said central section into the receptacle, said base being inserted into said receptacle, said spokes comprising one or more suction cups which engage one or more wall portions of said receptacle by attachment of said suction cups to said wall portions; and a lamp apparatus connected to said base, said lamp apparatus comprising a light bulb, an inner tube, and an outer tube, said inner tube and said outer tube being connected in telescopic engagement such that the distance between said light bulb and said receptacle is adjustable, said receptacle being capable of accommodating an object extending towards said light bulb.

4. The lamp fixture of claim 3 wherein said object is a live plant.

5. The lamp fixture of claim 3 wherein said object is an artificial plant.

* * * * *

UNITED STATES PATENT AND TRADEMARK OFFICE

CERTIFICATE OF CORRECTION

PATENT NO. : 6,217,198 B1
DATED : April 17, 2001
INVENTOR(S) : Paul Midiri, Jr.

It is certified that error appears in the above-identified patent and that said Letters Patent is hereby corrected as shown below:

Title page, Item [54] and Column 1, line 1,
Delete "PLANT LAMP FIXTURE" and insert -- PLANT LAMP FIXTURE HAVING HOLLOW RECEPTACLE AND ADJUSTABLE LAMP PORTION FOR ARTIFICIAL OR LIVE PLANTS -- therefor;

Column 2,
Line 44, delete "and";
Line 47, delete "." and insert -- ; --;
Line 50, delete "." and insert --; --;
Line 53, delete "." and insert -- ; and --;
Line 64, delete "30";

Column 3,
Line 4, after "elevated" delete "4";
Line 4, after "hole" insert -- 5 --;
Line 8, after "hole" insert -- 5 --;
Line 12, after "50," insert -- or other --;
Line 12, after "receptacle" delete the second occurrence of "receptacle";
Line 17, delete "etc." and insert -- or other -- therefor;
Line 32, delete "based" and insert -- base -- therefor.

Signed and Sealed this

Seventeenth Day of September, 2002

*Attest:*

*Attesting Officer*

JAMES E. ROGAN
*Director of the United States Patent and Trademark Office*